US005593058A

United States Patent [19]

Spencer et al.

[11] Patent Number: 5,593,058

[45] Date of Patent: Jan. 14, 1997

[54] ADJUSTABLE CRATES

[76] Inventors: Richard Spencer, 468 E. Margarita Rd., Rialto, Calif. 92376; Robert Pinkus, 26375 Palo Mita Cir., Mission Viejo, Calif. 92691

[21] Appl. No.: 511,996

[22] Filed: Aug. 7, 1995

[51] Int. Cl.[6] ..... B65D 6/24

[52] U.S. Cl. ..... 220/4.31; 220/4.28; 220/533; 220/4.34; 217/65

[58] Field of Search ..... 220/4.28, 4.31, 220/4.33, 4.34, 532, 533; 217/65, 12 R, 13, 43 R, 45; 206/600

[56] References Cited

U.S. PATENT DOCUMENTS

| | | | |
|---|---|---|---|
| 131,258 | 9/1872 | Evarts | 217/65 |
| 760,974 | 5/1904 | Dyarman et al. | 217/65 |
| 2,257,536 | 9/1941 | Roycroft | 220/532 |
| 2,809,404 | 10/1957 | Hinds | 217/65 |
| 3,301,200 | 1/1967 | Landsiedel | 108/51 |
| 3,329,103 | 7/1967 | Cohen | 108/54 |
| 3,429,472 | 2/1969 | Rogers, Jr. | 217/65 |
| 3,878,796 | 4/1975 | Morrison | 108/56 |
| 3,989,156 | 11/1976 | Lowry | 220/4 |
| 4,048,754 | 9/1977 | Laux | 217/65 |
| 4,359,948 | 11/1982 | Judy et al. | 108/56.1 |
| 4,703,866 | 11/1987 | Scott | 217/65 |
| 4,979,446 | 12/1990 | Winebarger | 108/51.3 |
| 5,058,746 | 10/1991 | Morgan, IV | 206/597 |
| 5,094,175 | 3/1992 | Christie | 108/56.1 |
| 5,170,722 | 12/1992 | Friesner et al. | 108/56.1 |
| 5,215,205 | 6/1993 | Behlman | 220/4.31 |
| 5,360,128 | 11/1994 | Hessenthaler | 220/4.33 |

*Primary Examiner*—Stephen J. Castellano
*Attorney, Agent, or Firm*—Roy, Kiesel & Tucker

[57] ABSTRACT

An adjustable crate assembly is disclosed. The assembly is composed of a pair of opposing sidewalls and adjustable crossbars which connect the opposing sidewalls. The crossbars connect to mateable portions on the inner surfaces of the panels which make up the sidewalls. The crossbars serve as a top of bottom to the crate and hold the item being crated. In one embodiment the sidewalls and the crossbars are formed of modular panels which may be strung together end to end.

10 Claims, 3 Drawing Sheets

ADJUSTABLE CRATES

BACKGROUND OF THE INVENTION

1. Field of the Invention

This invention relates, generally, to crates and, particularly, to adjustable crates.

2. Prior Art

Historically, the moving and storage industry has utilized wooden crates specifically made to fit a particular item to be moved or stored. Each crate is essentially custom made and not reusable. This method has been used almost as long as there has been a moving and storage industry.

The typical approach for the moving industry today is to enclose valuable items such as pictures, mirrors, marble tabletops, objects d'art, etc. in a crate. Each item to be crated must be measured in advance of the move. Using these measurements, the custom crates are constructed in a shop. The typical shipping crate is made using 1"×4" lumber and nails or staples. It typically includes four sides that surround the item, four corner gussets, and one or more bottom cross bars. These components are fastened together using nails or staples. One or more top cross bars are cut to length and shipped with the crate. These crates, one for each item to be crated, are then transported to the location of the items to be crated. The appropriate prefabricated crate is matched with the item. The item is protected using paper, plastic or foam and placed in the crate. The loose top cross bars are attached using nails or staples. The item is then loaded for shipment. When the items are uncrated, the top cross bars are removed using a hammer or crowbar and the item is removed from the crate.

There are a number of disadvantages to using this system of crating. It requires that measurements be taken in advance and allowances be made for padding. This carries the risk of error which can result in an ill-fitting (oversized) or unusable (undersized) crate. Pre-measuring requires a special trip to the home or business being moved, prior to the actual move, and is a time-consuming process. After measurements are taken, the crate must be fabricated. Each set of item dimensions must be translated into crate dimensions, a translation which creates another risk of error. All components must be cut to length and assembled. Loose components must be attached to avoid loss in shipment. Additionally, manual assembly with lumber and nails or staples is a time-consuming process.

During the crating process, severe damage to the item can occur as the top cross bars are attached. A misplaced nail or a mistake with a hammer strike can render an expensive painting or mirror worthless. A similar hazard exists when the item is uncrated and a crowbar is used to remove nails or staples. Even when the crate is fabricated correctly, the item is packed properly and no damage occurs in assembly or disassembly; the method currently used is very time-consuming. Additionally, the current method is wasteful because the crates and crate components are not reusable.

There is a need for a crating system which is easy to assemble and disassemble without danger to the item being crated and strong enough to protect the item during transit. The system should have the ability to use only a small number of standard components and construct a crate of any size needed at the time of the move without the need of advance measurements and construction. Ideally, the system would also have reusable components.

Various attempts have been made to provide such a system. However, none have provided a crate which meets all of the above mentioned criteria.

OBJECTS OF THE INVENTION

It is an object of the present invention to provide an adjustable crate assembly which uses a relatively few component pieces.

Another object of the present invention is to provide an adjustable crate assembly which can be adapted to crate items varying in size and shape without the need for measurements being taken in advance.

Another object of the present invention is to provide an adjustable crate assembly with reusable components.

Another object of the present invention is to provide an adjustable crate assembly which can be assembled with simple hand tools.

Another object of the present invention is to provide an adjustable crate assembly which will greatly reduce the possibility of damage to the item during assembly and disassembly.

SUMMARY OF THE INVENTION

An adjustable crate is disclosed. The crate includes a pair of opposing sidewalls which are connected by crossbars. The sidewalls are constructed of one or more sidewall panels, and each sidewall panel has an inner side which has a mateable portion. The crossbar ends are adapted to mate with the mateable portions of the sidewall panels so that the position of the crossbars can be adjusted relative to the sidewalls. In one embodiment each sidewall panel has male and female connector ends constructed so that the panels can be connected together in series. In one embodiment stops are used to secure the crossbars in position.

A feature of the invention is that it can be assembled with only a rubber mallet or other similar hand tool.

It is another feature of this invention that it is difficult for the user to assemble the components in an upside down or wrong configuration because of the one-way connectivity of the components.

Further objects, features, and advantages of the present invention will be apparent from the following description.

DETAILED DESCRIPTION

Figure 1:
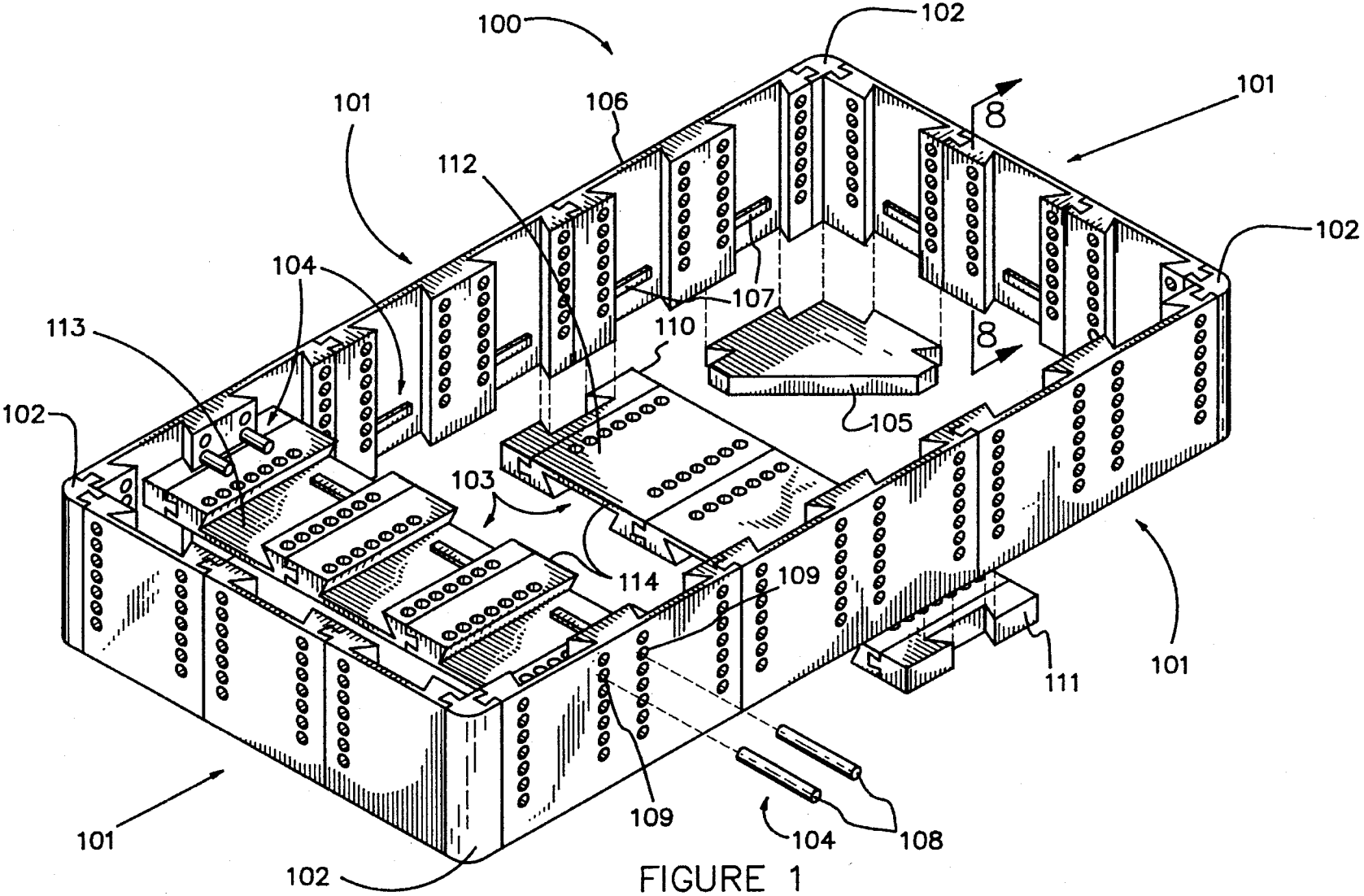
FIG. 1 is a perspective view of an embodiment of the invention.

Referring to FIG. 1, adjustable crate 100 is depicted. Depicted are sidewalls 101, corner pieces 102, crossbars 103, stops 104, and corner brace 105. Within each sidewall 101 are one or more sidewall panels 106, which are strung end to end to create the desired length sidewall 101. Joining sidewalls 101 are corner pieces 102, which connect to the ends of sidewall panels 106. One or more crossbar panels 114 (which can be constructed so as to be identical to sidewall panels 106) are also strung end to end to construct crossbars 103. Completing the make-up of crossbar 103 are female crossbar adapter 110 at one end and male crossbar adapter 111 at the other end, which adapt the ends of crossbar 103 for connection to sidewall panels 106 in sidewalls 101. Crossbars 103 will normally include at least one bottom crossbar 112, which will be below the crated item (not shown), and at least one top crossbar 113, which will be above the crated item. One or more corner braces 105 may be used to reinforce the crate.

Although the components are designed to fit snugly and to be held in place by friction, in the embodiment depicted stops 104 are used to further secure crossbars 103 in place along sidewalls 101. Two embodiments of stops 104 are shown. One or more tabs 107 are on each panel 106 and stop the sliding of crossbars 103 or corner brace 105. Another embodiment of stop 104 comprises pins 108 which may be inserted into pinholes 109. Instead of friction, one could also practice the invention using pins or tabs or any other means for adjustably and fixedly connecting crossbars 103 to sidewalls 101. One skilled in the art could also use any of various adhesives, either alone or in combination with the friction forces, to securely attach cross-bars 103 to sidewalls 101.

Figure 2:
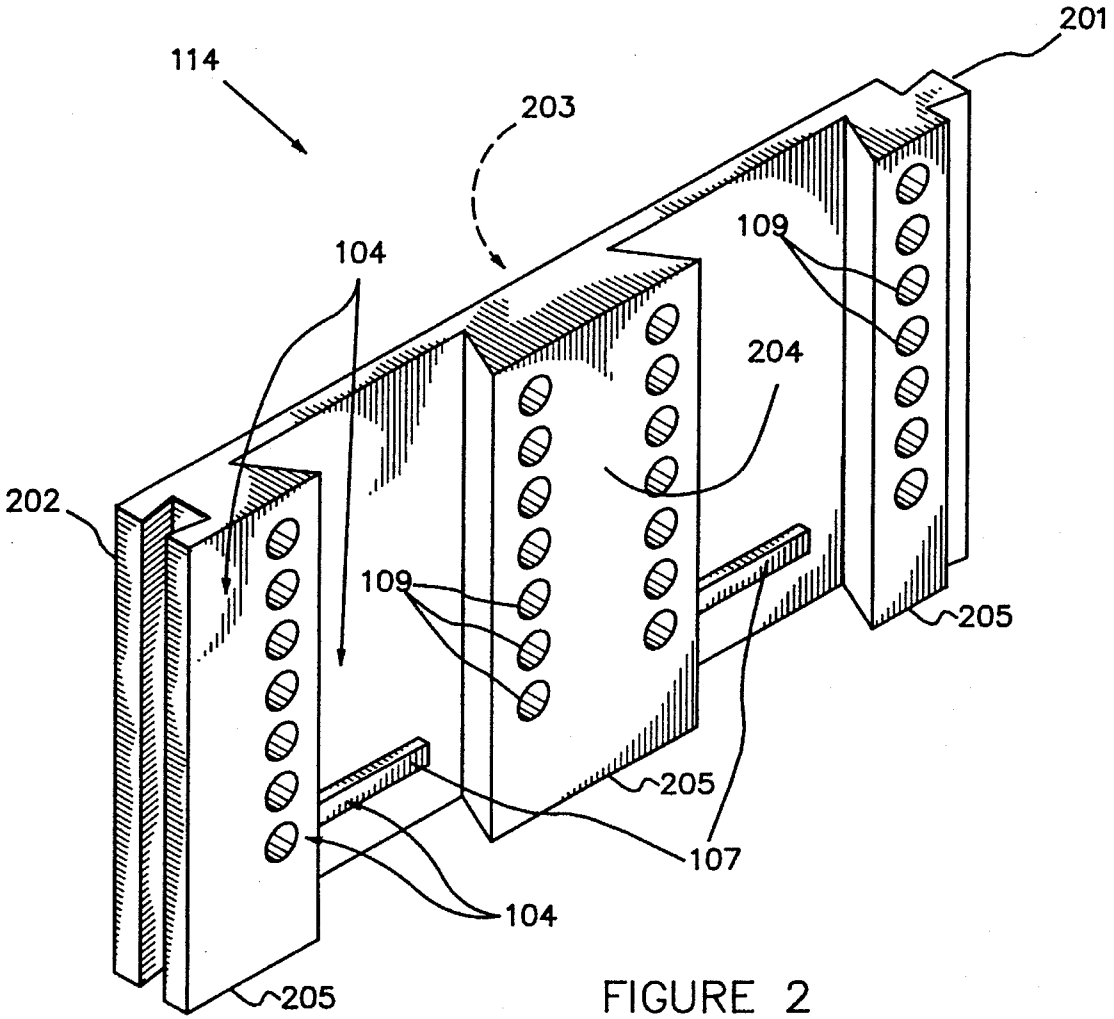
FIG. 2 is a perspective view of an embodiment of a panel. The panel can either be used as a sidewall panel or as a crossbar panel.

Referring now to FIG. 2, a perspective view of one embodiment of sidewall panel 106 is shown. Although the following description is for sidewall panel 106, it is to be understood that the following description would be identical for crossbar panel 114, using the same terms for parts of the panel. It is to be further understood that one could practice the invention with crossbar panels 114 having different dimensions than sidewall panels 106, or with crossbar panels 114 and sidewall panels 106 being identical. Additionally, one could use sidewall panels or crossbar panels of varying length strung together so long as the overall length of the sidewall or crossbar thus created fit properly with the other components. Sidewall panel 106 is a substantially planar rigid rectangular member having first panel connector end 201 and second panel connector end 202. The dimension between first panel connector end 201 and second panel connector end 202 shall be referred to as the length of sidewall panel 106. The dimension of sidewall panel 106 which is perpendicular to the length, and normally vertically oriented in a typical configuration, shall be referred to as the width of sidewall panel 106. In the embodiment depicted, sidewall panel 106 is constructed of molded plastic, but any rigid or substantially rigid material could be used. As discussed above sidewall panel 106 and crossbar panel 114 may be constructed of varying sizes, although it will be simpler to assemble the crate if they are identical.

The connector ends of sidewall panel 106 are constructed so that first panel connector end 201 of one panel is rigidly connectable to second panel connector end 202 of another sidewall panel 106. Sidewall panels 106 may then be strung end to end for use in sidewall 101. Similarly, crossbar panels 114 may be strung end to end for use in crossbar 103. Sidewall panel 106 has outer panel side 203 and inner panel side 204. Inner panel side 204 has one or more mateable portions 205 running parallel to said first and second panel connector ends 201, 202. Mateable portions 205 are constructed to be mateable with female crossbar adapter 110 and male crossbar adapter 111 of crossbar 103. One skilled in the art could also substitute other types of connectors for the male and female dovetails of the embodiments depicted. For example, one could use structures which present L-shaped or T-shaped cross-sections, or any structure used to mate pieces together. A one-way configuration is preferable to prevent confusion during assembly. All components may be made to fit together tightly so as to be held in position by friction.

In the embodiment shown, sidewall panel 106 will also include one or more stops 104 such as tabs 107 and pinholes 109. As seen in FIG. 1, when crossbar 103 or corner brace 105, or both, are engaged with mateable portion 205, they may be slid along mateable portion 205 until stopped by tab 107 or pin 108 inserted into pinhole 109. Although in the embodiment depicted, stops 104 are tabs or pins, one could use screws, bendable tabs, tape, adhesive, or any other means capable of securing crossbar 103 so it does not slide along sidewall 101.

In the embodiment shown, first panel connector end 201 is a male dovetail shaped member and second panel connector end 202 is a female dovetail shaped member, constructed so that first panel connector end 201 of a first sidewall panel 106, or crossbar panel 114, is slidably engageable with second panel connector end 202 of a second sidewall panel 106, or crossbar panel 114. Because the opposing connector ends are unique, as long as the user puts the inner panel side 204 of a first panel on the same side as the inner panel side 204 of a second panel to which the first panel is connected, sidewall panels 106, or crossbar panel 114, will not be reversed or upside down.

In the embodiment shown, first panel connector end 201 is a male member and second panel connector end 202 is a female member. One skilled in the art could reverse this relationship as long as the one way connectivity of the panels was preserved. One skilled in the art could also substitute other types of connectors for the male and female dovetails of the embodiments depicted. For example, one could use structures which present L-shaped or T-shaped cross-sections, or any structure used to mate pieces together. As discussed earlier, a one-way configuration is preferable. In a broad form, the invention could also be practiced with only one pair of opposing sidewalls 101 connected by crossbars 103, with each sidewall 101 containing only one sidewall panel 106. In this form, sidewall panel 106 would not need any connectable ends.

Figure 3:
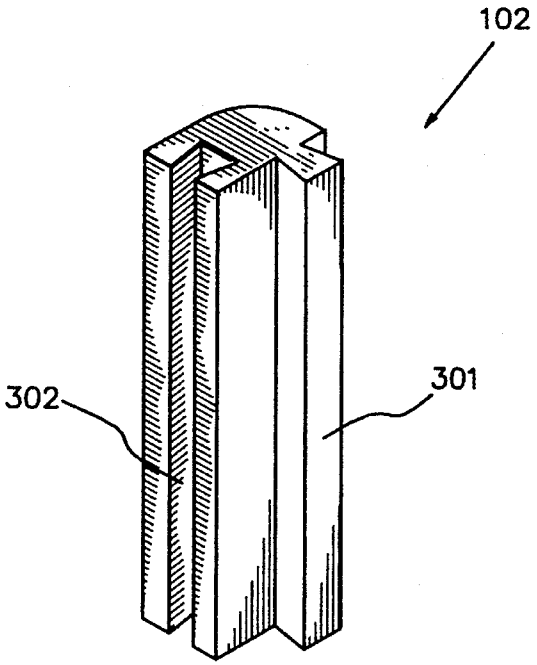
FIG. 3 is a perspective view of an embodiment of a corner piece.

In the embodiment depicted in FIG. 3, corner piece 102 is a substantially rigid elongated member having a first corner connector end 301 and a second corner connector end 302. In the embodiment depicted corner piece 102 is constructed of molded plastic, but any rigid or substantially rigid material could be used. First corner connector end 301 is constructed so as to present the same profile as first panel connector end 201 and second corner connector end 302 is constructed so as to present the same profile as second connector end 202. Being so constructed, first corner connector end 301 is connectable to second panel connector end 202 and second corner connector end 302 is connectable to first panel connector end 201 so that when four corner pieces 102 are connected to sidewalls 101, a four-walled member with two pairs of opposing sidewalls is formed as shown in FIG. 1. In the embodiment shown in FIG. 3, first corner connector end 201 is a male dovetail shaped member and second corner connector end 202 is a female dovetail shaped member. As discussed earlier for sidewall panels 106 and crossbar panels 114, the exact type of mateable structure used for corner piece 102 is not critical, although it is preferable to preserve the one-way connectivity feature.

Referring again to FIG. 1, within crossbars 103 are one or more crossbar panels 114 strung together. At one end of crossbar 103 is female crossbar adapter 110 and at the other end of crossbar 103 is male crossbar adapter 111. In the embodiment depicted identical panels are used for both sidewalls panels 106 and for crossbar panels 114. One can see that in this embodiment if the user places the same number of panels within crossbar 103 as are used in those sidewalls 101 parallel to crossbar 103, crossbar 103 will engage inner panel sides 204 after adding female and male crossbar adapters 110, 111 at each end of crossbar 103. Female crossbar adapter 110 is so named because it is mateable with the male dovetail structure found on first connector end 201 of the end panel 106 of crossbar 103. Male crossbar adapter 111 is so named because it is mateable with the female dovetail structure found on second connector end 201 of the other end panel 106 of crossbar 103. One skilled in the art can also see that in its most basic embodiment, crossbar 103 could be a one piece member adaptable at each end to engage with mateable portion 205 of panels 106 in sidewalls 101.

Figure 5:
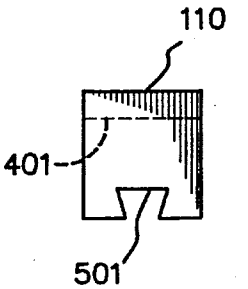
FIG. 5 is an end view of the female crossbar adapter depicted in FIG. 4, shown from view line 5—5.
Figure 4:
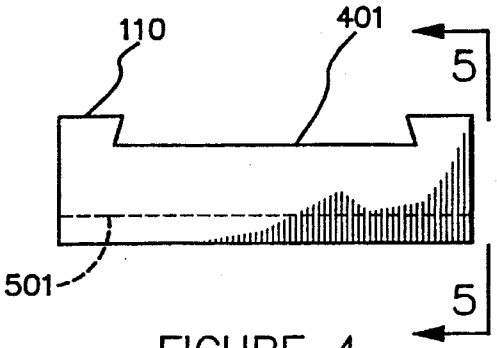
FIG. 4 is a top view of an embodiment of a female crossbar adapter.

Referring now to FIG. 4, a side view of female crossbar adapter 110 is shown. Female adapter large recess 401 will engage a mateable portion 205 of inner panel side 204 of sidewall panel 106. FIG. 5 is an end view of female crossbar adapter 110. Female crossbar adapter 110 will mate with crossbar panel 114 on the end of crossbar 103 by sliding first panel connector end 201 of crossbar 113 into female adapter small recess 501.

Figure 7:
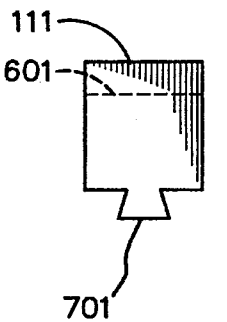
FIG. 7 is an end view of the male crossbar adapter depicted in FIG. 6, shown from view line 7—7.
Figure 6:
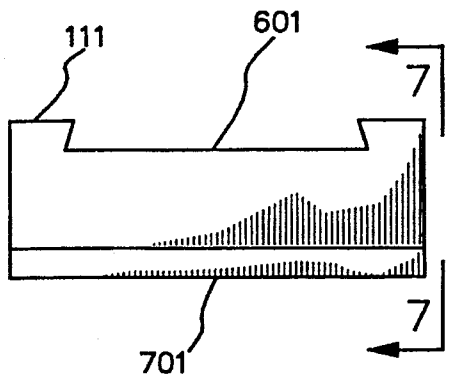
FIG. 6 is a top view of an embodiment of a male crossbar adapter.

Referring now to FIG. 6, a side view of male crossbar adapter 111 is shown. Male adapter large recess 601 will engage a mateable portion 205 of inner panel side 204 of sidewall panel 106. FIG. 7 is an end view of male crossbar adapter 111. Male crossbar adapter 110 will mate with crossbar panel 114 at the end of crossbar 103 by sliding male adapter ridge 701 into second panel connector end 202 of crossbar panel 114.

In the embodiment shown, mateable portion 205 is a male member and both female crossbar adapter 110 and male crossbar adapter 111 have female recesses which mate with mateable portion 205. One skilled in the art could reverse this relationship as long as the crossbars remained connectable to sidewalls 101. One skilled in the art could also substitute other types of connectors for the male and female dovetails of the embodiments depicted. For example, one could use structures which present L-shaped or T-shaped cross-sections, or any structure or other fastener or connector used to mate pieces together.

Figure 8:
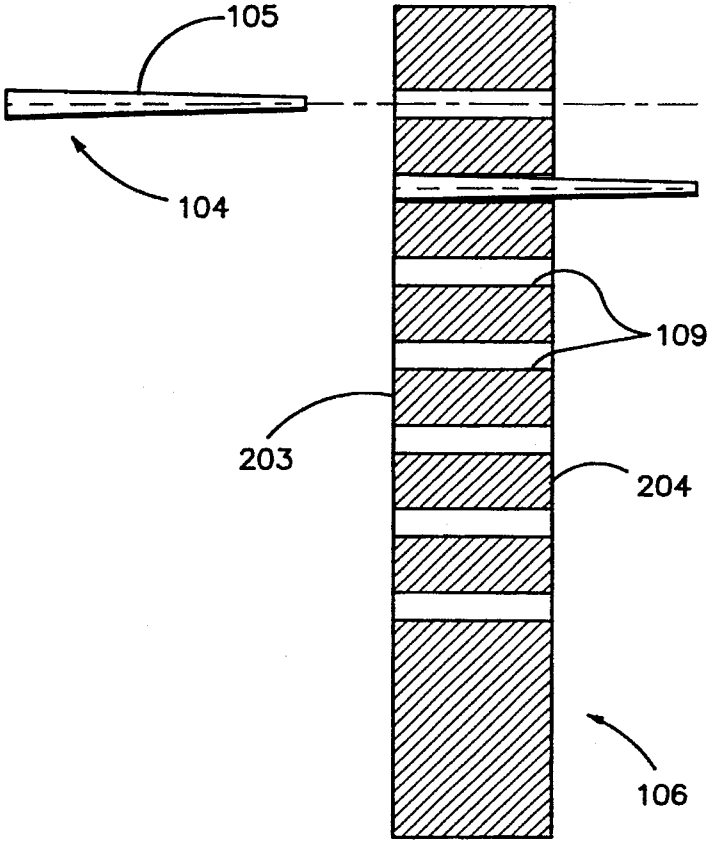
FIG. 8 is a sectional view, along section line 8—8 of FIG. 1, of an embodiment of a panel, suitable for use as either a sidewall panel or a crossbar panel, further depicting an embodiment of a stop.

Referring now to FIG. 8, a sectional view of sidewall panel 106 which depicts an embodiment of stop 104 is shown. Sidewall panel 106 will contain at least one pinhole 109 which has openings on both sides of sidewall panel 106. Pin 108 is constructed to fit tightly in pinhole 109 so that, as pin 108 is driven into pinhole 109 from outer panel side 203, pin 108 will be held in place by friction once pin 108 protrudes from pinhole 109 past the plane of inner panel side 204. Pin 108 is designed to be driven into place by a simple tool such as a rubber mallet. Pin 108 can be backed out of pinhole 109 by using a rubber mallet, or a similar tool to knock pin 108 toward outer surface panel side 103.

It is also possible for one skilled in the art to practice the invention by assembling a crate consisting of four sidewalls 101 connected by four corner pieces 102, and reinforced by at least two corner braces 105. In this embodiment the crate would be as shown in FIG. 1 but without crossbars 103.

In operation, the user assesses the size of the item requiring crating. Using sidewalls 106, the user assembles at least one pair of opposing sidewalls 101 which will be of appropriate length to contain the item. The user then places the pair of opposing sidewalls 101 upside down so that tabs 107 are up and places one or more crossbars 103 in place. This step is done by engaging corner crossbar 103 with mateable portion 205 and sliding crossbar 103 along mateable portion 205 until crossbar 103 contacts tab 107. The two-walled member, now with one or more crossbars 103, is then returned to a right side up position so that crossbars 103 are on the bottom. The item is then placed in the crate, using padding material if desired, and one or more crossbars 103 are slid along mateable portions 205 until the item is securely held, again using padding material if desired. If desired, the user may then drive one or more pins 108 into pinholes 109 just above crossbar 103 so as to further keep crossbar 103 from sliding up along mateable portion 205. One could also construct the crate in a similar fashion but add another pair of opposing sidewalls 101 and corner pieces 102 so that a four-walled member is formed.

Although the embodiment depicted shows a conventional four-sided member with a bottom structure and a top structure, it is to be understood that one skilled in the art could adapt this invention to various types of configurations such as three sided members, pyramid structures, or even five, six, or eight sided structures.

For the embodiments described above, the various components are constructed of molded plastic. However, one skilled in the art could construct the components of any materials which exhibit the rigidity and strength necessary for crating particular items. An advantage of constructing the items of recyclable plastic material is that one could either reuse the actual components, or one could crush the materials so that they could be recycled in the traditional sense.

There are of course other alternate embodiments which are obvious from the foregoing descriptions of the invention which are intended to be included within the scope of the invention as defined by the following claims:

We claim:

1. An adjustable crate, comprising:

(1) four sidewalls, each said sidewall having one or more sidewall panels, each said sidewall panel having an inner sidewall panel side having one or more mateable portions;

(2) four corner pieces connectable to said sidewalls, each said corner piece adapted such that when said corner pieces are connected to said sidewall panels of said sidewalls, a four-walled member with two pairs of opposing sidewalls is formed;

(3) two or more corner braces, each said corner brace being fixedly connectable to said mateable portions of said sidewall panels immediately adjacent to each said corner piece, and said sidewall panels, said corner pieces, and said corner braces being adapted such that said sidewall panels, said corner pieces, and said corner braces are adjustably and fixedly connectable:

(4) each said sidewall panel further comprising a first panel connector end and a second panel connector end opposite said first panel connector end, each said first panel connector end being connectable only to a second panel connector end but not connectable to another first panel connector end and each said second panel connector end being connectable only to a first panel connector end but not connectable to another second panel connector end; and (5) each said corner piece further comprising an elongated member having a first corner connector end and a second corner connector end, said first corner connector end being connectable to said second panel connector end, said second corner connector end being connectable to said first panel connector end.

2. An adjustable crate, comprising:

(1) at least one pair of opposing sidewalls, each said sidewall having one or more sidewall panels, each said sidewall panel being a substantially planar member having an inner panel surface having one or more mateable portions, each said mateable portion extending along the entire width of said inner panel surface;

(2) one or more crossbars, selectively connectable at each end to said pair of opposing sidewalls and adapted such that each said crossbar is selectively connectable to said mateable portions at any point along the entire width of said sidewall panel, each said crossbar being a substantially planar member adapted to support an item held in said crate, at least one of said crossbars being a bottom crossbar adapted to fit below the item to be crated;

(3) said sidewalls and said crossbars being adapted such that said sidewalls and said crossbars are substantially perpendicular to one another, and said mateable portions and said crossbars being adapted such that friction holds said mateable portions and said crossbars in place once they have been selectably connected;

(4) one or more stops for securing each said crossbar in position after said crossbar has been connected with said mateable portions;

(5) each said sidewall panel further comprising a first panel connector end and a second panel connector end opposite said first panel connector end, said sidewall panels adapted such that a plurality of said sidewall panels may be connected together at said panel connector ends and being further adapted such that said sidewall panels are held together by friction once connected; and (6) each said first panel connector end being connectable only to a second panel connector end but not connectable to another first panel connector end and each said second panel connector end being connectable only to a first panel connector end but not connectable to another second panel connector end.

3. The adjustable crate in claim 2, wherein each said crossbar is constructed of a first crossbar adapter at one end, a second crossbar adapter at another end, and one or more crossbar panels intermediate said first and second crossbar adapters, said first and second crossbar adapters being adapted such that said first and second crossbar adapters are selectably connectable to said mateable portion on said inner panel surface of said sidewall panels of said opposing sidewalls, said crossbar panels and said first and second crossbar adapters being adapted such that said crossbar panels and said first and second crossbar adapters are held together by friction once connected.

4. The adjustable crate in claim 3, further comprising:

(1) two pairs of said opposing sidewalls; and (2) four corner pieces connectable to said sidewalls, each said corner piece adapted such that when said corner pieces are connected to said sidewall panels of said sidewalls, a four-walled member with two pairs of opposing sidewalls is formed; and (3) said sidewall panels and said corner pieces being adapted so that said sidewall panels and said corner pieces are held together by friction once connected.

5. The adjustable crate in claim 4, wherein each said corner piece comprises an elongated member having a first corner connector end and a second corner connector end, said first corner connector end being connectable to said second sidewall panel connector end, said second corner connector end being connectable to said first sidewall panel connector end.

6. The adjustable crate in claim 5, further comprising one or more corner braces, each said corner brace being connectable to said mateable portions of said sidewall panels immediately adjacent to said corner brace.

7. The adjustable crate in claim 6, wherein each said stop further comprises a tab fixably attached to said inner surface of said sidewall, said tab adapted to fix the position of said crossbar.

8. The adjustable crate in claim 7, wherein each said stop further comprises each said panel having one or more pinholes adapted to receive a pin, said pin and said pinholes being adapted so that after said pin is inserted into one of said pinholes a portion of said pin fixes the position of said crossbar.

9. The adjustable crate in claim 8, wherein said sidewall panels and said crossbar panels are identical.

10. The adjustable crate in claim 2 wherein said mateable portions and said crossbars have been permanently fastened to each other to hold said mateable portions and said crossbars in place once they have been selectively connected.

* * * * *